US006666758B1

(12) United States Patent
Parrott

(10) Patent No.: US 6,666,758 B1
(45) Date of Patent: Dec. 23, 2003

(54) LAWN MOWER BLADE SHARPENER

(76) Inventor: Joseph Parrott, 1437 Delamr St., Jacksonville, FL (US) 32205

( * ) Notice: Subject to any disclaimer, the term of this patent is extended or adjusted under 35 U.S.C. 154(b) by 417 days.

(21) Appl. No.: 09/607,737

(22) Filed: Jun. 30, 2000

Related U.S. Application Data

(60) Provisional application No. 60/141,808, filed on Jul. 1, 1999.

(51) Int. Cl.[7] ..... B24B 23/00

(52) U.S. Cl. ..... 451/349; 76/82.1; 451/45; 451/359

(58) Field of Search ..... 76/82.1, 89.1, 76/89.2; 451/344, 45, 349, 354, 355, 356, 357, 358, 359

(56) References Cited

U.S. PATENT DOCUMENTS 3,800,480 A * 4/1974 Keating ..... 451/421
3,932,908 A * 1/1976 Bitgood et al. ..... 15/24
4,202,067 A * 5/1980 Stamatovic ..... 451/359
4,250,587 A * 2/1981 Beck, Jr. ..... 15/28
4,389,911 A * 6/1983 Winning ..... 76/74
4,463,525 A * 8/1984 Sheber ..... 15/28
4,919,117 A * 4/1990 Muchisky et al. ..... 15/28
5,018,228 A * 5/1991 Bogaerts et al. ..... 451/359
5,218,787 A * 6/1993 Rice ..... 451/229
5,321,912 A * 6/1994 Neary et al. ..... 451/141
6,092,450 A * 7/2000 Dueck ..... 83/174

* cited by examiner

*Primary Examiner*—Timothy V. Eley
(74) *Attorney, Agent, or Firm*—Thomas C. Saitta

(57) ABSTRACT

A device and method for sharpening the blade of a lawn mower without removing the blade from the mower, the device comprising a motor, a flexible drive cable, a grinder housing and a two-sided grinding disk. Most preferably, the motor is powered by a rechargeable battery, and the drive cable is connected to the grinder housing by a universal joint.

11 Claims, 1 Drawing Sheet

LAWN MOWER BLADE SHARPENER

This application claims the benefit of U.S. Provisional Application No. 60/141,808, filed Jul. 1, 1999.

BACKGROUND OF THE INVENTION

This invention relates generally to the field of devices used for sharpening lawn mower blades, and more particularly to the field of portable devices which allow the blade to be sharpened without removing the blade from the mower.

Lawn mowers comprising a gasoline or electric motor which rotates a cutting blade to shear the blades of grass are well known. The cutting blade in its most common configuration is centrally mounted on a generally vertical rotating axis or shaft and extends to either side of the shaft, such that two cutting edges are presented against the grass as the blade is rotated by the motor. The cutting edges are produced with a sharp or angled face in order to better bite and cut the individual grass blades. Over time, these cutting edges become dulled, and it is necessary to sharpen the cutting edges to maintain efficient operation. The frequency of the need for sharpening is determined by the amount of usage and type of grass and debris encountered by the mower. While a home owner may be able to mow for many months without noticing a drop in efficiency and cutting ability, commercial mowers which are in use daily and which may encounter roadside debris or other hard objects must be sharpened every few weeks or even more often. In order to sharpen the blade, it must be removed from the mower, which is usually accomplished by tipping the mower or the blade housing on its side and removing a bolt to free the cutting blade from the shaft. Removal of the bolt is often very difficult because dirt, grease and physical debris become entrapped in the threading. Once the cutting blade is removed, it is brought to a fixed grinding wheel, where the blade is sharpened on a rotating abrasive disk. To properly sharpen the blade, both the upper and lower side of the blade must be abraded. The blade is then returned to the mower and reattached. This method of sharpening creates a significant amount of downtime for the mower unless an extra blade is maintained so that the blades can be swapped in one operation—an issue not critical to the homeowner but very critical to commercial mowing businesses. Even with blade swapping, there remains the necessity to deliver the blade to the physical location of the grinding wheel.

It is an object of this invention to provide a device which addresses the problems of lawn mower blade sharpening discussed above. In particular, it is a object of this invention to provide a method and a device for sharpening the cutting blade of a lawn mower which does not require removal of the blade from the mower. It is a further object to provide such a method and device where the sharpening can be accomplished at remote locations, so that the mower does not need to be brought in from the field. It is a further object to provide such a method and device where the device is portable and easily operated. These objects and others not explicitly set forth in this paragraph are accomplished as expressed in the disclosure which follows.

SUMMARY OF THE INVENTION

The invention is in general a lawn mower blade sharpening device and a method of sharpening lawn mower blades using the device. The device comprises a motor to produce rotational movement of a flexible drive cable, where a two-sided grinding disk is attached to the drive cable such that operation of the motor rotates the grinding disk at a relatively high speed. The grinding disk is composed of a material suitable for removing metal from the dull mower blade in order to create a sharp edge. Preferably, a universal joint is provided between the flexible cable and the grinder body or grip to provide for maximum maneuverability of the grinding disk. The motor is preferably battery operated, but may also be electrically or gasoline operated. With this device, the lawn mower blade can be sharpened without the need to remove the blades from the mower, as the combination of flexible drive cable and two sided grinding wheel enable the operator to abrade both sides of the cutting blade to create a sharp edge.

DETAILED DESCRIPTION OF THE INVENTION

Figure 1:
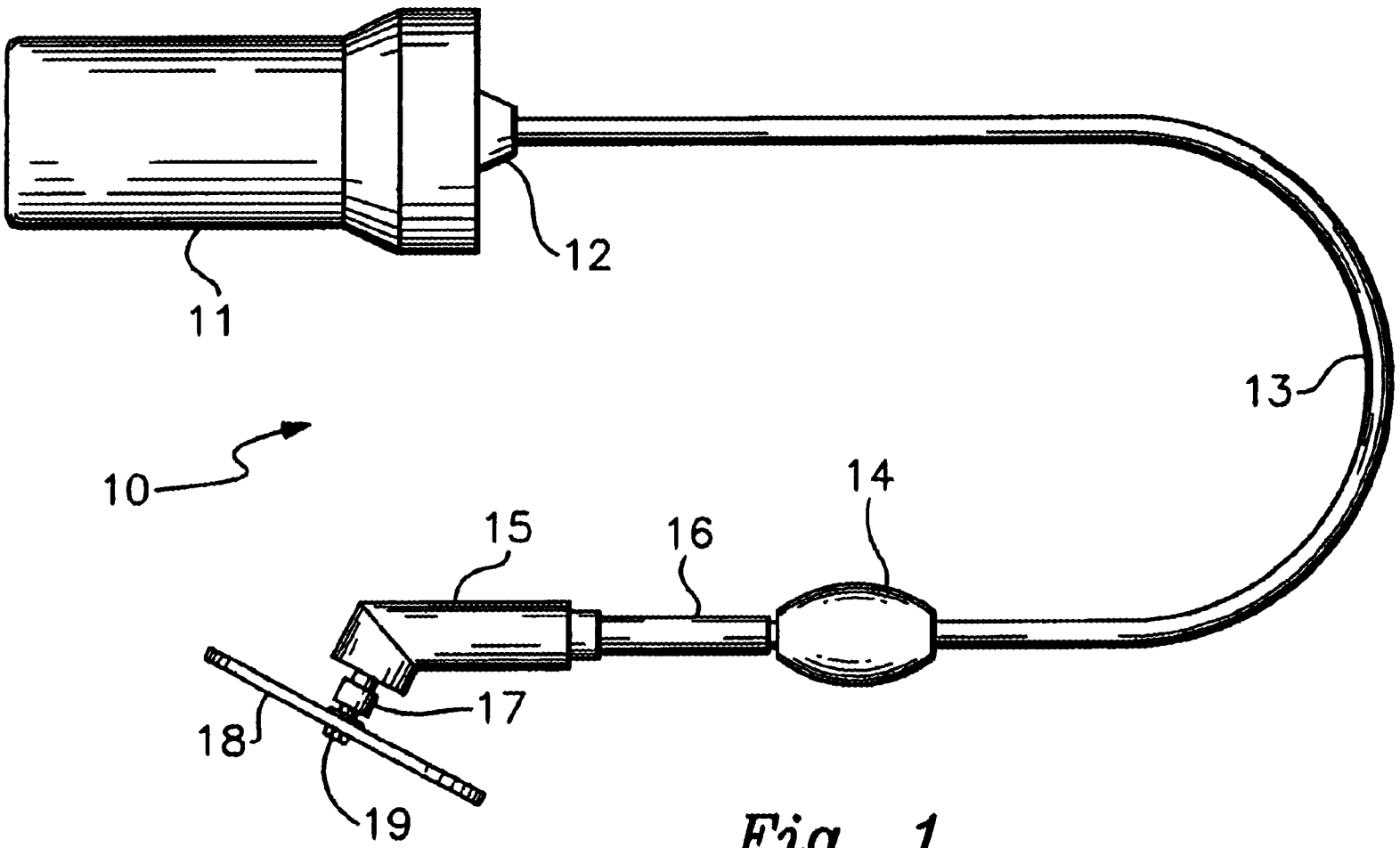
FIG. 1 is view of the invention showing the major components.

With reference to the drawing, the invention will now be described in detail with regard for the best mode and the preferred embodiment. In general, the invention is a sharpening device 10 for lawn mower blades and a method of sharpening lawn mower blades with the blades remaining attached to the mower, where the device comprises a motor drive or power means 11, a flexible drive cable 13 and a two-sided grinding or abrading disk 18.

As shown in FIG. 1, the blade sharpening device 10 is a powered device having a means to impart high speed rotation to a circular grinding disk 18. Preferably the power means is a relatively small motor 11 which delivers axial rotation, where the motor 11 can be powered by connection to a standard electric power supply through a standard power cord or by connection to a source of stored electrical energy, such as a battery, or where the motor 11 is self-powered by internal combustion or comprises a rechargeable battery. A suitable motor 11 may comprise a unit drawing approximately 5 to 6 amperes and operating at a no load speed of approximately ten to fifteen thousand rpm. Most preferably, the motor 11 is powered by a rechargeable battery, as portability is a preferred characteristic. With this construction, the motor 11 can be recharged when not in use, and there will be no connection requirements when the device 10 is used in the field.

The motor 11 produces axial rotation which is transferred to a flexible drive cable 13 by a coupling 12. Coupling 12 joins the flexible drive cable 13 to the motor 11 either in a fixed or detachable manner. The drive cable 13 may be of varying length, providing it is of sufficient length to enable the user to freely manipulate the grinder disk 18 through various angles. Preferably the drive cable 13 is of sufficient length such that the operator does not need to hold the motor 11 but can place it on the ground or a suitable support member. The drive cable 13 has a flexible covering encasing an internal rotating flexible drive member, and such constructions are well known.

The flexible drive cable 13 delivers the rotational force to a two-sided grinding or abrading disk 18. Grinding disk 18 is connected to a grinder body or housing 15 in a manner which allows the grinding disk 18 to be removed and replaced when its abrasive properties are diminished. Typically, the grinding disk 18 is centrally apertured and affixed to a disk retaining member 19 having a bolt or sleeve which in turn is releasably connected to the shaft 17 of the grinder housing 15. The rotational axis of the grinding disk 18 is preferably oriented at an acute angle relative to the main rotational axis of the grinder housing 15, but it is possible to orient the rotational axis of the grinding disk 18 at an angle of zero or ninety degrees to the rotational axis of the grinder housing 15 without departing from the utility of the invention. The grinder housing 15 is formed of a suitably durable material such as a hard plastic or metal, and is preferably provided with a handle or grip member 16 sized to allow the operator to hold and manipulate the grinding disk 18 with one hand.

The grinding disk 18 may be of any type suitable for abrasion of the metal lawn mower blade, and is most preferably relatively thin in cross-section, yet not so thin as to be flexible. The grinding disk 18 is functional on both sides, such that either side of the grinding disk 18 may be utilized to sharpen the mower blade. This enables the operator to easily abrade either side of the mower blade without having to excessively orient the grinder disk 18.

Most preferably, the blade sharpening device 10 is provided with a universal joint 14 which is located between the grinder housing 15 and the flexible drive cable 13. A universal joint allows the rotational axis of the grinder housing 15 to be oriented at an infinite number of angles and directions relative to the rotational axis at the end of the drive cable 13. This dramatically increases the maneuverability of the grinder housing 15 at a point relatively close to the lawn mower blade, and thus greatly increases the number of possible positions into which the grinding disk 18 can be placed without requiring excessive flex on the drive cable 13. While the drive cable 13 is flexible over a given distance, the amount of flex at any given point is limited by the cable construction, in that it is physically impossible to bend the drive cable 13 beyond a given limit of curvature inherent in the drive cable 13 within a given distance while still maintaining its functionality. By providing a universal joint 14 adjacent the grinder housing 15, this inherent flexibility limitation is no longer a problem, in that the rotational axis of the grinder housing 15 is angularly alterable relative to a fixed point within the universal joint 14 rather than over an arc of the drive cable 13. This enables the operator to easily orient the grinding disk 18 to the proper angle relative to the blade being sharpened.

The methodology of the invention is rather straightforward. The mower blade to be sharpened is made accessible by for example tipping the mower or the blade housing onto its side to expose the blade. The blade is not removed from the mower. The operator actuates the motor 11 to rotate the grinding disk 18, holding the grinder housing 15 in one hand on the handle 16. The desired angle for the sharpened edge on the mower blade is determined, and the most accessible side of the grinding disk 18 is positioned in parallel and directed against the dull edge of eh blade to remove some of the metal. Sharpening the opposite side of the cutting edge is easily accomplished by utilizing the opposite side of the grinding disk 18. In this manner a blade can be properly sharpened in a matter of minutes.

It is contemplated that equivalents and substitutions for certain components set forth above may be obvious to those skilled in the art, and the true scope and definition of the invention therefore is to be as set forth in the following claims.

I claim:

1. A lawn mower blade sharpening device for sharpening lawn mower blades without requiring the blades to be removed from the mower, the device comprising power means to provide axial rotation, a flexible drive cable connected to said power means, a grinder housing connected to said drive cable, wherein said drive cable is connected to said grinder housing by a universal joint, and a two-sided grinding disk connected to said grinder housing, whereby said power means rotates said grinding disk with sufficient speed and power to abrade the edge of a lawn mower blade.

2. The device of claim 1, wherein said power means comprises an electric motor.

3. The device of claim 1, wherein said power means comprises a motor powered by a battery.

4. The device of claim 3, wherein said battery is rechargeable.

5. The device of claim 1, wherein said grinder housing has a rotational axis and wherein said grinding disk has a rotational axis, and further wherein said rotational axis of said grinder disk is at an acute angle to said rotational axis of said grinder housing.

6. The device of claim 1, where said device is portable.

7. A lawn mower blade sharpening device for sharpening lawn mower blades without requiring the blades to be removed from the mower, the device comprising power means to provide axial rotation, a flexible drive cable connected to said power means, a grinder housing connected to said drive cable, wherein said drive cable is connected to said grinder housing by a universal joint, and a two-sided grinding disk connected to said grinder housing, said grinding disk being thin in cross-section, non-flexible and adapted for grinding on each of two sides, whereby said power means rotates said grinding disk with sufficient speed and power to abrade the edge of a lawn mower blade.

8. The device of claim 7, wherein said power means comprises an electric motor.

9. The device of claim 7, wherein said power means comprises a motor powered by a battery.

10. The device of claim 9, wherein said battery is rechargeable.

11. The device of claim 7, wherein said grinder housing has a rotational axis and wherein said grinding disk has a rotational axis, and further wherein said rotational axis of said grinder disk is at an acute angle to said rotational axis of said grinder housing.

* * * * *